United States Patent [19]

Lems

[11] Patent Number: 4,654,878

[45] Date of Patent: Mar. 31, 1987

[54] PLASTIC BAG CHAIN

[75] Inventor: Peter Lems, Wilmette, Ill.

[73] Assignee: Signode Corporation, Glenview, Ill.

[21] Appl. No.: 689,040

[22] Filed: Jan. 8, 1985

Related U.S. Application Data

[63] Continuation of Ser. No. 429,508, Sep. 30, 1982.

[51] Int. Cl.[4] ..... B65D 33/16

[52] U.S. Cl. ..... 383/37; 53/459; 53/568; 383/7; 383/35; 383/63; 383/65

[58] Field of Search ..... 383/37, 63–65, 383/7, 35; 53/459, 568

[56] References Cited

U.S. PATENT DOCUMENTS

| | | | |
|---|---|---|---|
| Re. 27,174 | 9/1971 | Ausnit | 383/65 |
| 3,151,649 | 10/1964 | Mitchell, Jr. | 383/7 |
| 3,618,286 | 11/1971 | Membrino | 53/459 |
| 3,688,463 | 9/1972 | Titchenal | 53/459 |
| 3,699,746 | 10/1972 | Titchenal et al. | 53/187 |
| 3,744,211 | 7/1973 | Titchenal et al. | 53/29 |
| 3,790,992 | 2/1974 | Herz | 383/64 |
| 3,817,017 | 6/1974 | Titchenal | 53/459 |
| 4,260,116 | 4/1981 | Collin | 53/568 |

FOREIGN PATENT DOCUMENTS

| | | |
|---|---|---|
| 4615346 | 4/1974 | Japan . |
| 49-39153 | 10/1974 | Japan . |
| 79/1328 | 8/1981 | South Africa . |
| 79/1329 | 8/1981 | South Africa . |
| 79/1330 | 8/1981 | South Africa . |

*Primary Examiner*—Stephen P. Garbe

*Attorney, Agent, or Firm*—Hill, Van Santen, Steadman & Simpson

[57] ABSTRACT

A serially interconnected chain of reclosable, zipper-lock plastic bags is arranged for facilitated handling in an automatic bag filling machine. The bag chain may be formed with single or plural connecting spot links between side edges of adjacent bags to maintain alignment of the bags in the chain as the chain is unwound from storage and threaded along a lateral transport path running through the filling machine. The connecting links are adapted to be broken during the loading operation so that separate, loaded bags may be discharged from the machine for packaging. Each bag is formed with raised ridge surface means running laterally thereacross adapted to be slidably received in a suitable guide track means of the filling machine to provide vertical support for the bags as the chain is being drawn between various work stations in the filling machine.

7 Claims, 9 Drawing Figures

10
11
20
24
25
26
27
35
36
37
38
39
A
B
C
D
IV 11
22
41

11
15
16
17
21
40

10
11
12
13
14
15
16
21
22
23
II
III 11
12
14
15
16
17
27
28
29
30
31

VIII
VIII
11'
12'
13'
14'
15'
16'
17'
42
44
45
46
47
48
51
52
53
54
56
57
58
59
11''
12''
15''
16''
17''

PLASTIC BAG CHAIN

This is a continuation, of application Ser. No. 429,508, filed Sept. 30, 1982.

CROSS-REFERENCE TO RELATED APPLICATIONS

The instant application relates to subject matter disclosed in the following commonly assigned U.S. patent applications, all filed Sept. 30, 1982, concurrently with this application:

1. Ser. No. 429,506, entitled "Registration Of Bags In A Filling Machine" by Richard W. Scheffers,
2. Ser. No. 429,617, now U.S. Pat. No. 4,490,959, entitled "Method And Mechanism For Filling Bags" by Peter Lems,
3. Ser. No. 429,507, now U.S. Pat. No. 4,517,788, entitled "Mechanism For Filling Bags Of Different Sizes" by Richard W. Scheffers.

BACKGROUND OF THE INVENTION

The invention relates to means for transporting and dispensing plastic container bags and, more particularly, to means for transporting and dispensing reclosable zipper-lock plastic bags in the form of a chain to be fed through an automatic machine for loading zipper-lock type plastic bags.

Reclosable zipper lock plastic bags are formed of flexible thin plastic film and have closed bottom and side edges and a reclosable upper end mouth. Running fully across opposed inner facing surfaces of the mouth are a pair of cooperatively interlocking fastener strip profiles formed with respective engageable rib and groove elements made of extruded plastic material. The specific nature of manufacture and handling of reclosable plastic bags of this nature is more fully disclosed, for example, in U.S. Pat. Nos. 3,198,228, 3,291,177, 3,338,284, and 3,340,116. Reclosable zipper lock plastic bags are typically closed at their mouth ends during the manufacture process in order to allow proper interfitting of the rib and groove members and exit the manufacturing site in that closed condition. The fastener strip profiles may be either integrally extruded with the plastic film or subsequently attached to interior film surfaces in a later step.

Heretofore, the loading of zipper lock plastic bags has not been found conducive to an automated machine process. It has been necessary to provide manual loading of such reclosable plastic bags on an individual basis, which is very expensive in terms of labor costs and requires much time since the loader must first manually open the initially closed bag, deposit fill material into the bag, manually interlock the bag mouth fastener strips, and finally transfer the loaded bag to a packaging station. Individual loading may also take place through an open bottom edge of each bag after which the bottom edge is heat sealed.

Recently, however, automatic machinery has been devised for feeding, opening, loading, and reclosing zipper lock plastic bags which conducts a series of interconnected bags along a travel path between work stations in the machine. Details of this automatic filling machine are set forth in the commonly assigned applications referred to above.

The present invention is directed to an arrangement for the construction and dispensing of a serially connected chain of reclosable plastic bags which is conducive for being continuously fed into and through an automatic machine for the sequential loading of the bags.

SUMMARY OF THE INVENTION

A chain of bags is suitably provided to permit sequential feeding of the bags in seriatim fashion through an automatic bag filling machine, such as where the bag chain is wound in a layered roll about a horizontal shaft which can be rotatably unwound. The bags are each formed with closed bottom end and side edges and have a reclosable upper end mouth having interlocking fastener strip rib and groove profiles running, integrally or separately attached, across inner facing surfaces of the mouth. Raised ridge surfaces run along the face of each bag adjacent the mouth, or formed by the fastener strip profiles themselves, to vertically support the chain for slidable lateral movement along a track means formed in the machine. The machine contains a chain drive means for pulling the bags along the track means sequentially through various work stations. The bags are preferably interconnected with one another at adjacent side edges by upper and lower links, although in some instances only an upper link is needed. The upper and lower links provide for proper alignment of the bags in the chain during feeding into the machine. As bags are threaded into the machine, the lower link, when provided, is cut to permit displacement of the bottom end of the bags being loaded relative to the following adjacent bags. The upper link is aligned with the raised ridge surfaces and is retained to connect the bags in the chain during movement of the chain along the track means until after a bag has been filled. The rupture strength of the upper link is greater than the force used for pulling the chain through the machine, but less than the tear strength of the bags themselves.

DESCRIPTION OF THE PREFERRED EMBODIMENTS

Figure 1:
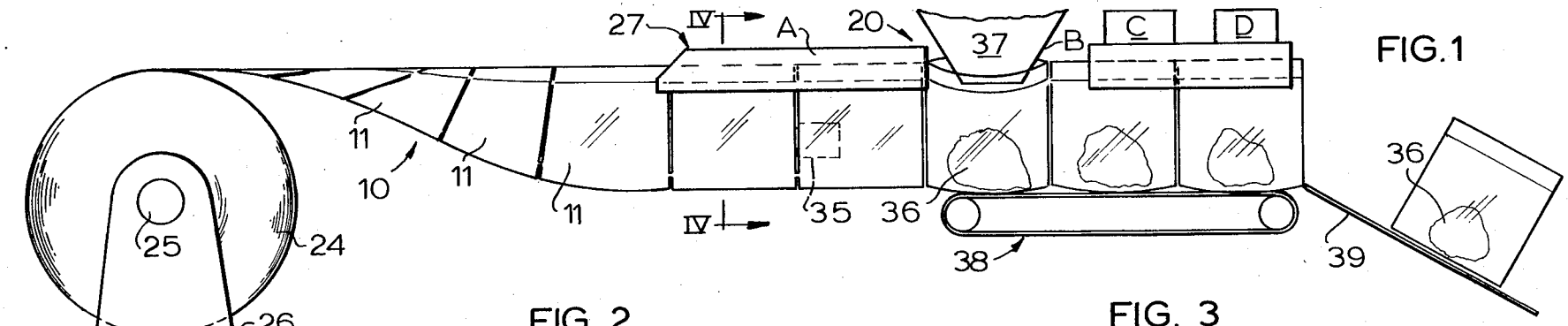
FIG. 1 is a partly schematic, side elevational view of a continuous bag chain constructed in accordance with the present invention being conducted through an automatic loading machine for handling reclosable zipper lock plastic bags.
Figure 3:
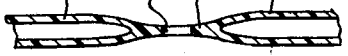
FIG. 3 is a fragmentary, cross-sectional view taken along the lines III—III of FIG. 5.
Figure 2:
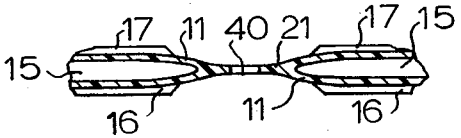
FIG. 2 is a fragmentary, cross-sectional view taken along the lines II—II of FIG. 5.
Figure 5:
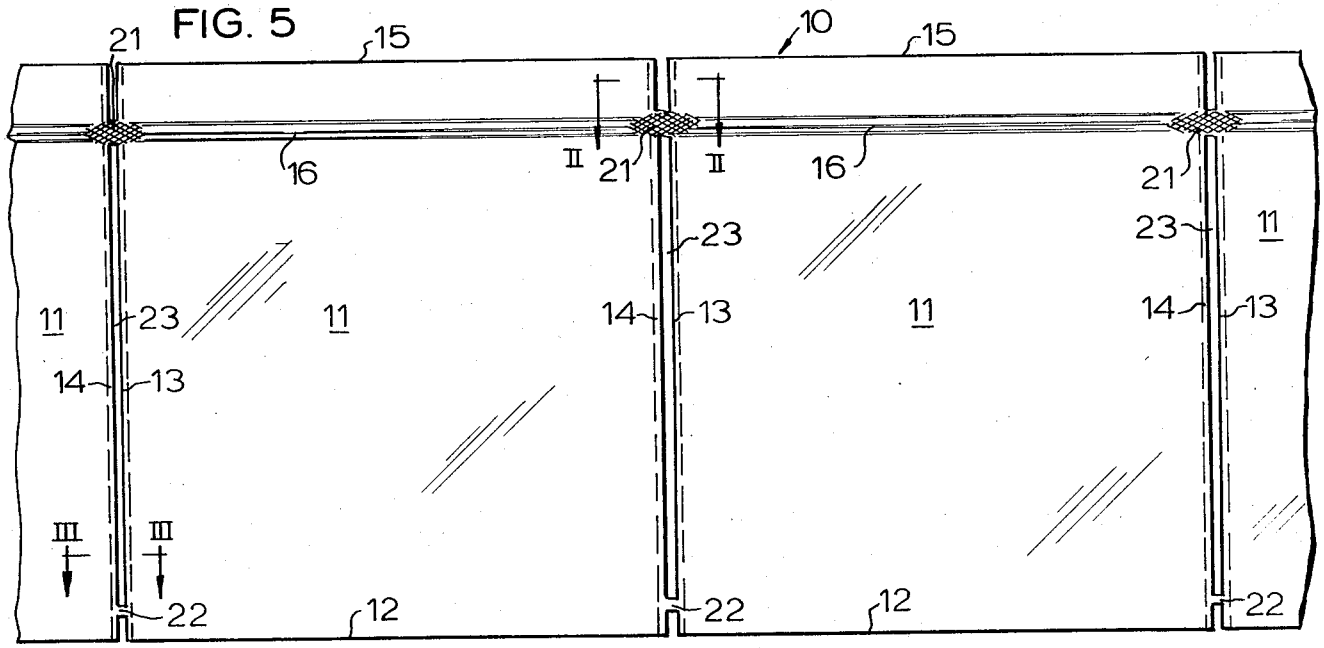
FIG. 5 is a fragmentary, side elevational view illustrating interconnections between individual bags in the bag chain of FIG. 1.

FIGS. 1–5 show a web chain 10 of serially interconnected plastic, preferably polyethylene, bags 11 of the reclosable zipper-lock type. Each of the bags 11 is formed of flexible thin plastic film with a closed bottom edge 12 and opposed closed side edges 13 and 14. The closed bottom edge of each bag 11 is preferably formed by folding over the front and back face surfaces of the bag, such that the bottom edge is not seamed. The side edges of each bag are heat sealed shut. The upper end of the bag is in the form of a reclosable mouth 15. Spaced inward from the top edge of the mouth and running fully laterally across opposed inner facing surfaces of the mouth are a pair of cooperatively interlocking fastener strip profiles made of extruded plastic in the form of respective engageable rib and groove elements 16 and 17. The fastener strip profiles 16 and 17, in accordance with this first embodiment, define raised ridge surfaces relative to the remainder of the bag along the front and back faces of the bag and are integrally formed on the bag film or separately attached thereto.

The bags of the chain 10 leave the manufacture site with the interlocking rib and groove elements 16 and 17 engaged, the bottom and side edges closed, and the upper edges of the facing surfaces of each bag mouth free of any interconnection and open. The bag chain 10 is adapted to permit serial handling of individual bags in an automatic bag loading machine, shown, for example, generally at 20. In order to be threaded through the filling machine 20 during loading operation, each of the bags are interconnected with frangible bridging portions between their adjacent side edges comprising relatively thin ultrasonic or heat seal plastic spot welds 21 and 22 located, respectively, adjacent upper and lower ends of the bags. An open space or gap 23 extending longitudinal of adjacent bags is thus defined between each two corresponding upper and lower weld joints 21 and 22. The supply of bag chain for feeding the filling machine 20 may be wound in a layered roll 24 about a horizontally disposed spool shaft 25 supported in opposed end bearing bracket means 26 to permit rotational unwinding of the chain roll 24. It may be desirable to have a small rotary motor assist rotation of the spool shaft 25 for unwinding of the chain roll 24 in correlation with the feed rate through the filling machine 20, so as to avoid unnecessary pull on the bag chain 10 which would cause unwanted breakage of the bag links 21 and 22. The bag chain roll 24 is disposed with a horizontal axis, rather than a vertical axis, in order to more readily retain alignment of the bag chain layers in the roll and avoid telescoping of the chain layers due to gravity along the spool shaft.

Upper and lower links 21 and 22 are used herein to interconnect adjacent side edges of the bags for a balanced support of the bags 11 in the chain 10. In this manner, the bags are adapted for lateral transport and unwinding without bag ends flopping around relative to one another and the chain 10 is permitted to be conducted readily through a 90° turn from a horizontal plane leaving, for example, the roll 24 to a vertical plane entering the filling machine 20, as shown in FIG. 1. However, there may occur chain feed arrangements where only a single link, probably the upper link 21, is necessary to interconnect bag side edges.

Figure 4:
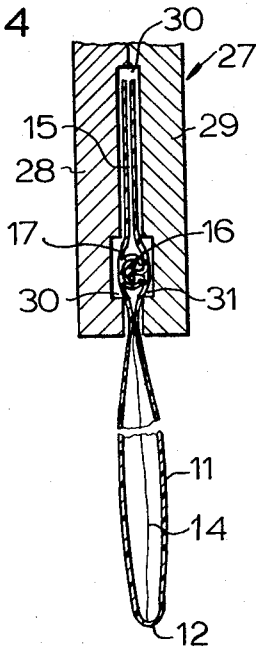
FIG. 4 is a fragmentary, cross-sectional view taken along the lines IV—IV of FIG. 1.

When the reclosable bags 11 leave the manufacture site wrapped in the roll 24, the fastener strip profiles are in an interlocked condition such that the mouths of the bags are closed. At the filling site, one end of the chain is threaded through a laterally extending track means 27 running through the filling machine 20 such that the bags initially enter the machine in the closed state. As shown in FIG. 4, the track means 27 are provided in the filling machine 20 with opposed facing parallel track surfaces 28 and 29 defining a flow space 30 therebetween through which bags of the bag chain are passed in seriatim. Each of the track surfaces is formed with a recess portion 30 and 31 respectively facing one another for receiving corresponding raised ridge surfaces, in this case the fastener strip profiles, such that the bags are vertically supported for sliding movement through the filling machine with the mouths facing upwards.

The filling machine 20 is of a type more fully disclosed in the above-referenced, commonly assigned patent applications. Generally, the device 20 contains, in sequence of operation on each bag in the chain 10, a bag opening station A, a filling station B, a drive and closing station C, and finally a separation and discharge station D. A reversible chain drive means (not shown) is provided in the machine 20 in the form of rotatably driven wheels having annular toothed or frictional surfaces for drivingly engaging the raised ridge surfaces of the bags in order to pull the chain along the track means 27 through the filling machine between the various work stations. By the time each bag reaches the bag opening station, it is supported along its raised ridge surfaces in the machine track means 27. Since the bag has now been unwound from the roll 24 and will soon have its bottom end displaced as the result of loading relative to that of the next succeeding bag, a cyclically operated slitter arrangement 35 is provided in the filling machine for cutting each lower end connecting link 22 adjacent the bag opening station. In the bag opening station, there is provided a device having a gripper wheel for displacing one fastener strip profile relative to the other corresponding profile to form an initial loop opening in the bag mouth 15. A finger member is then vertically inserted into the loop opening and the bag chain is indexed forward, bringing the partially opened bag into the filling station and simultaneously separating the remaining connected portions of the fastener strip profiles to fully open the bag mouth 15. In the filling station, fill material 36, such as candy, is passed into the opened bag through a suitable chute means 37. The lower end of the bag from the filling station to the end of the machine is supported on an endless rotary belt conveyor means 38 such that the weight of the fill material 36 in the loaded bags does not disrupt the flow of bags along the track means 27. After a bag is filled, the bag chain 10 is indexed further along the transport path to bring the filled bag into the closing station where the interlocking rib and groove elements are again interengaged and the bag mouth 15 is closed. From the closing station, the filled bag enters the separation and discharge station, where the filled bag is clamped and the succeeding bags of the bag chain are indexed in a rearward direction causing the remaining upper end connecting link 21 of the clamped bag to be broken. The filled bag is now separated from the bag chain and means are provided for dropping the separated, filled bag from the track means 27 out of the machine along a discharge chute 39 to a suitable packaging station.

The bottom link 22 is used primarily for maintaining bottom end alignment of the bags in chain 10 as the chain is unwound from the spool 25 and led into the machine 20, although in certain suitable circumstances the bottom link may not be needed. The upper link 21 serves to maintain upper end alignment of the bags in the chain during unwinding, but is further retained as the chain is conducted through the machine to maintain interconnection of the bags. The rupture strength for each upper link 21 is greater than the pulling force exerted on the chain by the machine chain drive means. At the same time, the rupture strength of the upper links must be less than the tear strength of the bag material itself so that, in the separation and discharge station D, it is the connecting links 21 which rupture and not the bags. Preferably, the rupture strength for upper links 21 is in a force range of two to seven pounds and the thickness of each face surface of the bag is in a range of one to six mils. For a balanced pulling support on the bags of the chain 10, the rupture strength of the upper and lower links at each instance of adjacent side edges 13 and 14 is substantially equal. As respectively shown in FIGS. 2 and 3, each upper and lower link 21 and 22 may be formed with areas 40 and 41, respectively, of relatively reduced thickness, or wholly open or split, to achieve the proper rupture strength.

The upper links 21 are substantially laterally aligned with the lengths of raised ridge surfaces formed on the bags. This construction is desired since the pulling force on the chain exerted by the machine drive means, in the forward and reverse directions, is conveyed through adjacent bags along the raised ridge surfaces in the track means 27. The pulling action on the chain is directly transferred between bags by virtue of the prescribed positioning of the upper links 21 in line with the raised ridge surfaces, eliminating the risk of tearing or distorting bag side edges adjacent to the raised ridge surfaces, and is directly applied to the upper links for rupturing in the separation station D.

In accordance with the first embodiment, raised ridge surfaces are provided along the lateral width of the bags by virtue of the fastener strip profiles. The ridge surfaces represent relatively thickened portions on each bag surface and this thickened surface portion provides a downwardly facing shoulder for engaging in and along the corresponding recess portions of the machine track means. It is also within the contemplation of the present invention that shoulder means may be afforded on the bags by virtue of suitable recess portions formed in bag surfaces and that the machine track means may utilize protruding surfaces to be received in the recess portions to slidably support the bags in the chain. It is further within the contemplation of the present invention that alternate provisions may be made for forming raised ridge surfaces on the reclosable plastic bags 11, other than by virtue of the fastener strip profiles, for support of the bags in and along the machine guide track means.

Figures 6, 7, 8, 9:
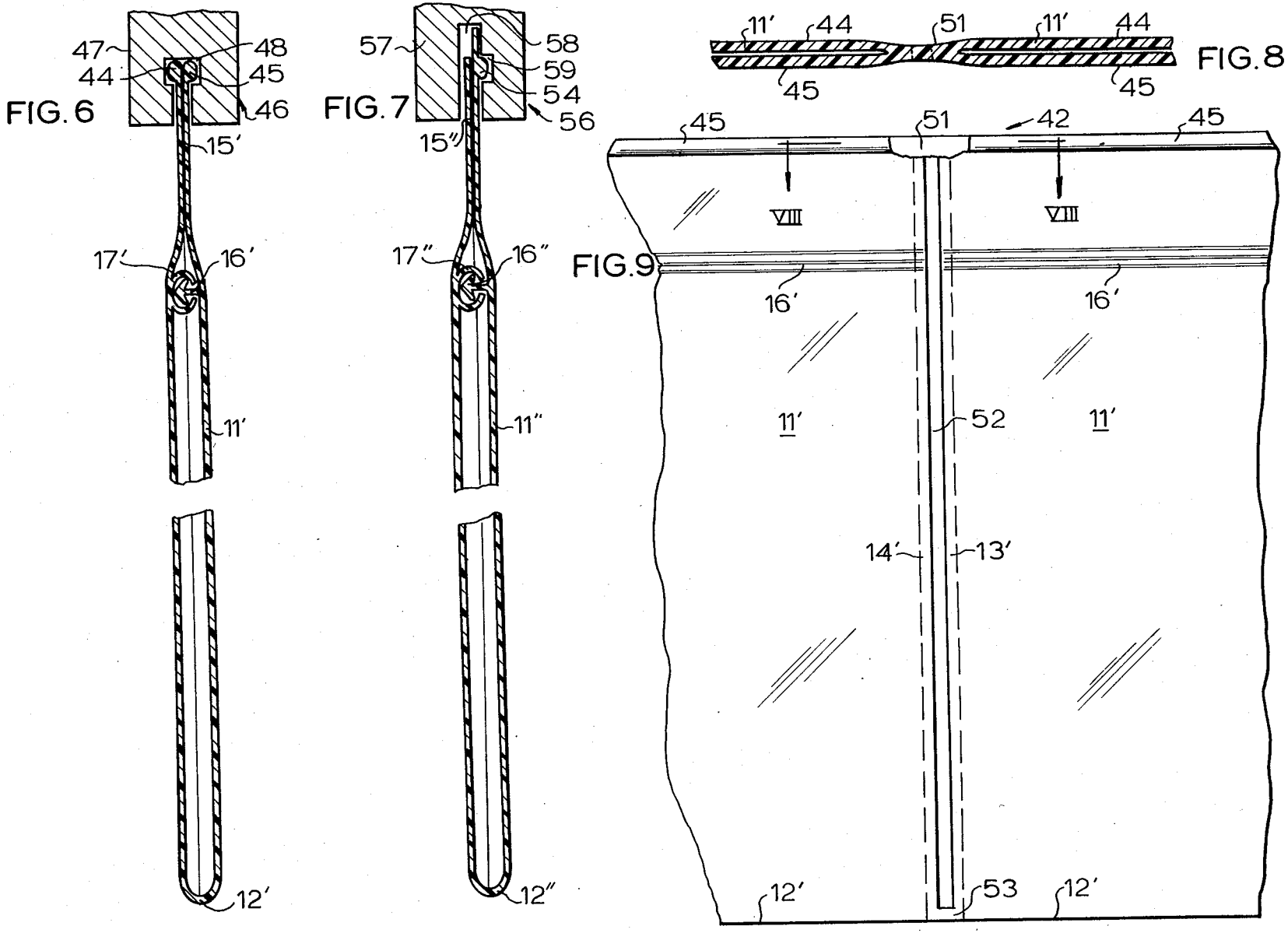
FIG. 6 is a fragmentary, cross-sectional view illustrating a second alternative embodiment construction for individual bags arranged in a bag chain of the present invention.
FIG. 7 is a fragmentary, cross-sectional view of a third alternative embodiment construction for individual bags arranged in a bag chain constructed in accordance with the present invention.
FIG. 8 is a fragmentary, cross-sectional view taken along the lines VIII—VIII of FIG. 9.
FIG. 9 is a fragmentary, side elevational view illustrating the interconnection between individual bags in the bag chain of FIG. 6.

FIGS. 6 and 8–9 show a second embodiment construction for a bag chain 42 constructed for handling in an automatic loading machine, such as 20, in the manner of bag chain 10. The interconnected bags of the bag chain 42 are substantially identical with the reclosable zipper lock plastic bags 11 and like numerals primed are carried over from the previous discussion. The bags of this embodiment differ from those of the first embodiment by virtue of the presence of opposed outwardly protruding bead lines 44 and 45 formed along the upper edges of opposed surfaces of the bag mouth 15'. The bead lines 44 and 45 serve as raised ridge surfaces for vertical support of the bag chain 42 in the filling machine. For conducting bags constructed in accordance with this embodiment, through the filling machine 20, there is provided a modified track means 46 defined by a wall surface 47 having a T-shaped flow space opening 48 extending laterally therealong. The upper end of the opening 48 is formed with suitable shoulder portions for laterally receiving the raised ridge surfaces 44 and 45 such that each bag 11' of the chain is vertically supported in the guide track means 46 with the mouth facing upwards.

Upper end connecting welds 51 are formed in similar fashion with the connecting links 21 described above and are positioned in line with the bead lines 44 and 45 between side edges of adjacent bags in the chain. Correspondingly spaced by gaps or open spaces 52 running longitudinal with the bags are respective lower end weld links 53 formed between adjacent side edges of the bags contiguous with the bottom ends 12' of the bags. The connecting links 53 are similarly constructed with the weld links 22 described above, except that the links 53 are aligned with the closed bottom edges of each bag in the chain to form a continuous bottom end on the chain.

It is further within the contemplation of the present invention to provide for a single line of raised ridge surface means for vertically supporting lateral sliding movement of the bags through a filling machine, such as 20. The third embodiment bag construction is shown in FIG. 7 wherein the bags are substantially identical with the reclosable, zipper lock plastic bags 11 described above and like numerals are double primed, except that a single outwardly protruding bead line member 54 is formed on one, relatively elongated face surface at the mouth end 15'' of the bag 11''. The raised surface 54, according to this embodiment, serves to vertically support the bags 11'' for transfer through the filling machine 20 by being received in a suitably constructed track means 56 having a wall surface 57 formed with a flow space opening 58 for receiving the upper end of the bag mouths 15'' laterally therethrough. The opening 58 is formed on one side with a recess portion 59 providing a shoulder edge for slidably receiving the bead members 54 for support of the bags through the machine 20.

The bag chain arrangement of reclosable zipper-lock plastic bags according to the present invention is specifically adapted for the handling of a continuous stream of individual bags by an automatic reclosable zipper-lock bag filling machine. The upper and lower connecting links between adjacent side edges of the bags in the chain provide for an aligned feeding of the bags into the filling machine, as well as permitting the bag chain to be wound into a layered roll on a horizontal spool for shipping and dispensing of the bag chain. The connecting links are set with a suitable rupture strength to permit separation of an individual bag from the chain in the loading operation. The bags of the bag chain of the present invention are specifically adapted for lateral conduction through an automatic bag filling machine by the presence of raised ridge surfaces running across each bag by which the bags can be vertically supported and guided for movement in the filling machine.

Although various minor modifications may be suggested by those versed in the art, it should be understood that I wish to embody within the scope of the patent warranted hereon all such modifications as reasonably and properly come within the scope of my contribution to the art.

I claim as my invention:

1. In combination a chain of laterally interconnected bags and a machine for filling them, each bag having bottom and side edges fully closed along the entire length thereof and a reclosable upper end mouth having interlocking fastener strip profiles running fully laterally across opposed inner facing surfaces of said mouth, said machine comprising drive means for pulling said chain disposed in and along a laterally extending linear track extending through the machine, with said track having a channel recess, means for filling said bags, and means for separating each filled bag from said chain, said bag chain comprising:

a sole linking means adjacent the upper end of said bag for interconnecting said bags withone another at adjacent side edges and transmitting chain pulling tension between adjacent bags, each linking means having a rupture strength less than that of said bags, and a ridge running laterally along at least one face of each said bag adjacent said mouth and precisely aligned with said linking means at each side edge of each said bag, said ridge having a thickness sufficient for extending into said channel recess for supporting said chain in and along said track.

2. The combination of claim 1, wherein said linking means has a rupture strength of between two and seven pounds.

3. The combination of claim 1, wherein both said linking means are plastic spot welds.

4. The combination of claim 1, wherein said linking means are plastic spot welds having an area of relatively reduced thickness.

5. The combination of claim 1, wherein said ridge comprises at least one outwardly protruding bead.

6. The combination of claim 5, wherein said ridge comprises a pair or outwardly protruding beads respectively formed on opposed surfaces of said mouth of each said bag.

7. The combination of claim 5, wherein said ridge is formed by said fastener strip profiles.

* * * * *